US005225303A

United States Patent [19]

Tomita et al.

[11] Patent Number: 5,225,303

[45] Date of Patent: Jul. 6, 1993

[54] DRY-TYPE TONER INCLUDING WAXES RELEASE AGENT FOR ELECTROPHOTOGRAPHY

[75] Inventors: Masami Tomita, Numazu; Toshiki Nanya, Mishima; Yasuaki Iwamoto, Numazu, all of Japan

[73] Assignee: Ricoh Company, Ltd., Tokyo, Japan

[21] Appl. No.: 771,124

[22] Filed: Oct. 3, 1991

[30] Foreign Application Priority Data

Oct. 5, 1990 [JP] Japan ..... 2-266372

[51] Int. Cl.[5] ..... G03G 9/083

[52] U.S. Cl. ..... 430/106.6; 430/110

[58] Field of Search ..... 430/106.6, 110, 111, 430/122, 137

[56] References Cited

U.S. PATENT DOCUMENTS

| | | | |
|---|---|---|---|
| 4,845,007 | 7/1989 | Hyosu | 430/137 |
| 5,047,305 | 9/1991 | Uchida et al. | 430/110 |
| 5,053,305 | 10/1991 | Aoki et al. | 430/110 |

*Primary Examiner*—John Goodrow
*Attorney, Agent, or Firm*—Cooper & Dunham

[57] ABSTRACT

A dry-type toner for electrophotography composed of a binder resin, a coloring agent, and a release agent which contains as the main components a carnauba wax substantially free of free aliphatic acids and/or a montan ester wax, and an oxidized rice wax with an acid value of 10 to 30.

11 Claims, No Drawings

DRY-TYPE TONER INCLUDING WAXES RELEASE AGENT FOR ELECTROPHOTOGRAPHY

BACKGROUND OF THE INVENTION

1. Field of the Invention

This invention relates to a dry-type toner for use in electrophotography and electrostatic printing to develop latent electric or magnetic images, and more particularly to a dry-type toner which exhibits high fixing ability even at low image-fixing temperatures and can be used in a thermal image fixing method employing an oil-less heat-application roller.

2. Discussion of Background

Latent electrostatic images formed in the course of electrophotography, electrostatic printing and electrostatic recording are developed with, in the case of a dry method, a dry-type toner comprising as its main components a binder resin and a coloring agent. The developed images are transferred to the surface of a copy paper, and then fixed thereon.

Toner images can be fixed on a copy paper by various image fixing methods. Among them, a thermal image fixing method using a heat-application roller is widely adopted, because high thermal efficiency can be obtained and high-speed fixation can be achieved when this method is employed.

In order to achieve high-speed fixation by the thermal image fixing method, a toner used therein is required to exhibit high image fixing ability even at low fixing temperatures. Therefore, a resin having a low softening point is incorporated into the toner as a binder resin.

However, when such a resin is contained in the toner, the toner images partially stick to the surface of a heat-application roller during the process of image fixing, and the toner adhering to the roller-surface is transferred to a copy paper to stain the background thereof. This is a so-called off-set phenomenon. Furthermore, the copy paper tends to wind around the heat-application roller when the temperature of the roller is low. In this Specification, this phenomenon is referred to as a "winding phenomenon".

In order to eliminate the above adverse phenomena, the addition of a lubricant or release agent, such as a solid silicone, a varnish, a higher fatty acid, a higher alcohol or a wax of various kinds, has been proposed as disclosed in Japanese Laid-Open Patent Applications 51-143333, 57-148752, 58-97056 and 60-247250. However, toners containing any of the above lubricants do not exhibit high resistance to the off-set and winding phenomena while maintaining high fixing ability at low temperatures.

For instance, polyolefin waxes such as a low-molecular-weight polyethylene and a low-molecular-weight polypropylene, which have conventionally been used in a toner as a lubricant, can impart to the toner high resistance to the off-set phenomenon, but cannot sufficiently improve the fixing ability at low temperatures.

Vegetable waxes such as carnauba wax and candelilla wax can impart to a toner both high resistance to the off-set phenomenon and excellent fixing ability at low temperatures, but cannot impart to the toner high resistance to the winding phenomenon.

Solid silicones, varnishes, silicone oils, amide waxes, higher fatty acids, higher alcohols and montan wax can improve the fixing ability at low temperatures, but cannot sufficiently impart to a toner the resistance to the off-set and winding phenomena.

In addition, the conventional lubricants cannot be thoroughly dispersed in a binder resin, so that they tend to separate from the toner during the process of development, and stick to a photoconductor or a development sleeve. A so-called filming problem is thus caused. Furthermore, since the toner containing the conventional lubricants tends to adhere to a carrier, the toner cannot stably produce high quality images for a prolonged period of time.

SUMMARY OF THE INVENTION

Accordingly, one object of the present invention is to provide a dry-type toner for electrophotography, having high resistance to off-set and winding phenomena.

Another object of the present invention is to provide a dry-type toner for electrophotography, exhibiting a low lower limit of the temperature range in which toner images can be fixed on copy paper.

A further object of the present invention is to provide a dry-type toner for electrophotography, which does not stain the background of copy paper, and does not scatter on copy paper during the image fixing process.

Yet another object of the present invention is to provide a dry-type toner for electrophotography, capable of producing images with high fidelity even after the repeated use, and usable for high-speed image fixation.

The above objects of the present invention can be achieved by a dry-type toner for electrophotography comprising a binder resin, a coloring agent, and a release agent which comprises (a) a carnauba wax substantially free of free aliphatic acids and/or a montan ester wax and (b) an oxidized rice wax with an acid value of 10 to 30.

DETAILED DESCRIPTION OF THE PREFERRED EMBODIMENTS

The dry-type toner according to the present invention comprises a release agent comprising a carnauba wax substantially free of free aliphatic acids and/or a montan ester wax, and an oxidized rice wax having an acid value of 10 to 30.

A conventionally employed carnauba wax generally contains about 10 wt.% of free aliphatic acids. By contrast, in the present invention, a carnauba wax which is substantially free of free aliphatic acids is employed. Such a carnauba wax can be obtained from the conventional carnauba wax by removing therefrom the free aliphatic acids to such an extent that the content of the free aliphatic acids is preferably 5 wt.% or less.

Due to the removal of the aliphatic acids to such an extent, the crystalline size of the carnauba wax for use in the present invention can be decreased to 1 μm or less, when dispersed in a binder resin, which is much smaller than that of the conventional carnauba wax, and can thus be much better dispersed in the binder resin than the conventional carnauba wax.

A toner comprising a carnauba wax containing more than 5 wt.% of free aliphatic acids exhibits low resistance to the winding phenomenon.

When the carnauba wax contains less than 2 wt.% of free aliphatic acids, on the other hand, the charge quantity of the toner considerably varies depending on the environmental conditions. With the above factors taken into consideration, the carnauba wax for use in the present invention preferably contains 2 to 5 wt.% of free aliphatic acids.

In the release agent contained in the dry-type toner according to the present invention, a montan ester wax may be used instead of the aforementioned carnauba wax or in combination with the same.

The montan ester wax for use in the present invention can be prepared by extracting a wax component from coal and purifying the same.

It is preferable that the acid value of the montan ester wax for use in the present invention be in the range of 5 to 14 from the viewpoint of dispersibility in the binder resin in the course of a kneading process for preparation of the toner.

In the toner according to the present invention, the release agent also comprises an oxidized rice wax having an acid value of 10 to 30.

A rice wax, the material of the oxidized rice wax for use in the present invention, can generally be classified into two groups. One is a rice bran wax prepared by removing a crude wax component from rice bran and purifying it; and the other is a hydrogenated rice wax which can be obtained by hydrogenating a crude wax component or a wax component obtained in the course of winterization of the rice bran. The oxidized rice wax for use in the present invention is prepared by oxidizing the former non-hydrogenated rice wax in air.

Most of the fatty acids which constitute the ester part of the former non-hydrogenated rice wax are long chain fatty acids such as behenic acid and lignoceric acid, which are excellent in the releasability, and therefore in the resistance to the winding phenomenon. Accordingly, the oxidized rice wax made from such a non-hydrogenated rice wax is contained in the toner as a release agent. In contrast to this, in the case of the latter hydrogenated rice wax, fatty acids having a relatively short carbon chain such as palmitic acid and stearic acid, which are poor in the releasability, constitute the ester part of the hydrogenated rice wax, so that the former non-hydrogenated rice wax is better than the latter hydrogenated rice wax as the raw material for the oxidized rice wax for use in the present invention.

The oxidized rice wax for use in the present invention has an acid value of 10 to 30 in accordance with JIS X 5902. When the acid value is less than 10, the lower limit of the temperature range in which toner images are fixed on copy paper is high and the image fixing performance at low temperatures becomes insufficient. When the acid value exceeds 30, on the other hand, the upper limit of the temperature range in which a cold off-set phenomenon occurs is high, and the image fixing performance at low temperatures is insufficient for use in practice.

It is preferable that the total incorporation amount of the carnauba wax and/or the montan ester wax be 0.2 to 20 wt.% of the total weight of the dry-type toner according to the present invention.

The incorporation amount of the oxidized rice wax is also preferably in the range of 0.2 to 20 wt.% of the total weight of the dry-type toner of the present invention.

When the release agent of the toner according to the present invention comprises (a) the above-mentioned carnauba wax and/or the montan ester wax, and (b) the oxidized rice wax, sufficient resistance to the off-set phenomenon can be imparted to the obtained toner, and in addition, the lower limit of the temperature range in which the toner images are fixed on copy paper can be lowered and the winding phenomenon can be prevented. Furthermore, when the toner images are fixed on a sheet of copy paper by using a heat-application roller, it is not necessary to coat a release agent on the roller surface. After the image fixing process, no toner deposition is observed on the background of copy paper, and images having high fidelity to original images can be continuously obtained. For these reasons, the toner of the present invention is suitable for high-speed image fixing.

In the toner according to the present invention, the aforementioned two components of the release agent are well-balancedly and uniformly dispersed in the binder resin, so that the release agent can be prevented from separating from the surface of the toner particle while the toner is stirred for an extended period of time for practical use. In the case of a two-component-type developer, therefore, the spent toner problem can be avoided. More specifically, the fused release agent contained in the toner particle does not adhere to the surface of the carrier particle. When the one-component-type developer is employed, the toner filming problem at the development unit and the surface of the photoconductor can be eliminated.

Furthermore, in the present invention, good dispersibility of the release agent in the binder resin can prevent the release agent from separating from the toner particle, so that the obtained toner can be used in a thermal image fixing method employing an oil-less heat-application roller.

The other components to be contained in the toner of the present invention will be explained below.

Various thermoplastic resins having a low softening point which have been used in the conventional toners can be used as the binder resin in the present invention.

Specific examples of the thermoplastic resins usable in the present invention include homopolymers of styrene or its substitution compounds such as polystyrene, poly-p-chlorostyrene and polyvinyltoluene; styrene-based copolymers such as a styrene - p-chlorostyrene copolymer, a styrene propylene copolymer, a styrene - vinyltoluene copolymer, a styrene - vinylnaphthalene copolymer, a styrene - methylacrylate copolymer, a styrene - ethylacrylate copolymer, a styrene -butylacrylate copolymer, a styrene - octylacrylate copolymer, a styrene - methylmethacrylate copolymer, a styrene - ethylmethacrylate copolymer, a styrene - butylmethacrylate copolymer, a styrene - methyl-α-chloromethacrylate copolymer, a styrene - acrylonitrile copolymer, a styrene - vinylmetyl ether copolymer, a styrene - vinylethyl ether copolymer, a styrene - vinylmethyl ketone copolymer, a styrene - butadiene copolymer, a styrene isoprene copolymer, a styrene - acrylonitrile - indene copolymer, a styrene - maleic acid copolymer and a styrene maleic acid ester copolymer; and polymethyl methacrylate, polybutyl methacrylate, polyvinyl chloride, polyvinyl acetate, polyethylene, polypropylene, polyester, polyurethane, polyamide, an epoxy resin, polyvinyl butyral, a polyacrylic resin, rosin, modified rosin, a terpene resin, a phenolic resin, an aliphatic hydrocarbon resin, an alicyclic hydrocarbon resin, an aromatic petroleum resin, chlorinated paraffin, and a paraffin wax. The above resins can be used either singly or in combination.

Of the above resins, a styrene-based resin containing both a high-molecular-weight component and a low-molecular-weight component with the ratio (Mw/Mn) of the weight-average molecular weight (Mw) to the number-average molecular weight (Mn) being 3.5 or greater, and a polyester resin are preferred because they can impart to the toner high fixing ability and high resistance to the winding phenomenon.

In the present invention, as the coloring agent can be used any of the known dyes and pigments such as carbon black, Lamp Black, Iron Black, Ultramarine Blue, Nigrosine dyes, Aniline Blue, Phthalocyanine Blue, Phthalocyanine Green, Hansa Yellow G, Rhodamine 6G, lake, Calconyl Blue, Chrome Yellow, quinacridone, Benzidine Yellow, Rose Bengale, triallyl methane dyes, monoazo dyes and pigments, and disazo dyes and pigments. The above dyes and pigments can be used either singly or in combination.

The incorporation amount of the coloring agent is, in general, 1 to 30 wt.%, preferably 3 to 20 wt.%, of the total weight of the dry-type toner of the present invention.

The toner according to the present invention can also be used as a two-component-type developer. In this case, the toner is mixed with a carrier powder. As such a carrier powder, any of the conventionally known carrier powder can be used. Examples of the carrier powder include powders having magnetic properties such as iron powder, ferrite powder and nickel powder, and glass beads. Furthermore, the above magnetic powders and glass beads can also be coated with a resin.

The toner of the present invention can be used as a magnetic toner by incorporating therein a magnetic material.

Examples of the magnetic material include iron oxides such as magnetite, hematite and ferrite, metals such as iron, cobalt and nickel, alloys or mixtures of any of the above metals and a metal such as aluminum, cobalt, copper, lead, magnesium, tin, zinc, antimony, beryllium, bismuth, cadmium, calcium, manganese, selenium, titanium, tungsten or vanadium.

The average diameter of the magnetic material is preferably 0.1 to 2 μm, and its incorporation amount is approximately 20 to 200 parts by weight, preferably 40 to 150 parts by weight, per 100 parts by weight of the binder resin contained in the toner.

Moreover, the toner of the present invention may further comprise any of the following auxiliary components, if necessary: a lubricant such as Teflon or zinc stearate, an abrasive substance such as cerium oxide or silicon carbide, a fluidity-imparting agent such as colloidal silica or aluminum oxide, a caking-preventing agent, an electro-conductivity-imparting agent such as carbon black or tin oxide, and a fixing-accelerating agent such as polyolefin having a low molecular weight.

Other features of this invention will become apparent in the course of the following description of exemplary embodiments, which are given for illustration of the invention and are not intended to be limiting thereof.

EXAMPLE 1

The following components were thoroughly mixed in a Henschel mixer.

| | parts by weight |
|---|---|
| Polyester resin (Number-average molecular weight Mn = 5000, Weight-average molecular weight Mw = 55000, Glass transition temperature Tg = 62° C.) | 100 |
| Carnauba wax containing 0.9 wt. % of free aliphatic acids (Melting point = 85° C., Acid value = 0.5) | 2 |
| Oxidized rice wax (Acid value = 13.0) | 1.5 |
| Carbon black (Trademark, "#44", made by Mitsubishi Carbon Co., Ltd.) | 7 |
| Chromium-containing monoazo dye (Trademark, "TRH", made by Hodogaya Chemical Co., Ltd.) | 2 |

The resulting mixture was placed in a roll mill pot, and kneaded at temperatures between 80° C. and 110° C. for approximately 40 minutes. The fused mixture was cooled to room temperature, crushed, and then classified, thereby obtaining a toner having a particle diameter of 5 to 20 μm.

Three parts by weight of the above-obtained toner and 97 parts by weight of ferrite carrier particles with a 100 to 250 mesh, coated with a silicone resin, were mixed in a ball mill pot, whereby two-component-type developer No. 1 according to the present invention was obtained.

The thus obtained developer was placed in a plain paper copying apparatus ("FT-7030", Trademark, made by Ricoh Company, Ltd.), equipped with a pair of Teflon-coated fixing rollers composed of a pressure-application roller and a heat-application roller, and images were continuously reproduced while keeping the temperature of the heat-application roller at 130° C. During the continuous reproduction operation, neither the off-set phenomenon nor the winding phenomenon was observed. Even after 100,000 copies were made, high quality images were obtained and the quality underwent no deterioration.

The fixing properties of the developer were evaluated in terms of the following temperatures:

(1) the lower limit of the temperature range in which a hot off-set phenomenon is observed, (2) the upper limit of the temperature range in which a cold off-set phenomenon is observed, (3) the temperature at which copy paper begins to wind around the heat-application roller, and (4) the lower limit of the temperature range in which toner images are fixed on copy paper.

More specifically, the temperatures of items (1) and (2) were determined by the following methods:

Toner images transferred onto the surface of a copy paper were fixed thereon under the conditions of a nip width of 4 mm and a line speed of the fixing rollers of 250 mm/sec, with the image fixing temperature changed. The toner gave rise to the off-set phenomenon at a low-temperature region and a high-temperature region. The off-set phenomenon observed in the low-temperature region is referred to as a cold off-set phenomenon, and the one observed in the high-temperature region is referred to as a hot off-set phenomenon. The upper limit of the temperature range in which the toner gave rise to the cold off-set phenomenon, and the lower limit of the temperature range in which the toner gave rise to the hot off-set phenomenon were determined by repeating the image fixing process while changing the temperature of the heat-application roller.

The temperature of item (3) was determined by the following method:

A solid toner image transferred onto almost the entire surface of a copy paper was fixed thereon under the same conditions as described above. The temperature at which the copy paper began to wind around the heat-application roller was measured by repeating the image fixing process while lowering the temperature of the heat-application roller.

The temperature of item (4) was determined by the following method:

Toner images were fixed on a copy paper under the same conditions as described above. The temperature at which 70% of the toner images was fixed on the copy paper was measured by repeating the fixing process while elevating the temperature of the heat-application roller. The image fixing rate was measured by a crockmeter.

The results are shown in Table 1. As shown in the table, all the data obtained in terms of the above items (1) to (4) were satisfactory.

COMPARATIVE EXAMPLE 1

The procedure for preparation of the two-component-type developer No. 1 in Example 1 was repeated except that the amount of the carnauba wax containing 0.9 wt.% of free aliphatic acids used in Example 1 was changed from 2 parts by weight to 3.5 parts by weight, and that the oxidized rice wax used in Example 1 was eliminated, whereby comparative two-component-type developer No. 1 was obtained.

By using the above-obtained developer, images were continuously reproduced in the same manner as in Example 1.

The fixing properties of the developer were also evaluated in the same manner as in Example 1. The results are shown in Table 1.

During the reproduction, the image fixing performance at low temperatures was slightly insufficient. The initial image quality was excellent, but slight toner deposition was observed on the background of the copy paper after 100,000 copies were made.

COMPARATIVE EXAMPLE 2

The procedure for preparation of the two-component-type developer No. 1 in Example 1 was repeated except that the amount of the oxidized rice wax used in Example 1 was changed from 1.5 parts by weight to 3.5 parts by weight, and that the carnauba wax used in Example 1 was eliminated, whereby comparative two-component-type developer No. 2 was obtained.

By using the above-obtained developer, images were continuously reproduced in the same manner as in Example 1.

The fixing properties of the developer were also evaluated in the same manner as in Example 1. The results are shown in Table 1.

During the reproduction, the image fixing performance at low temperatures was sufficient. The initial image quality was excellent, but slight toner deposition was observed on the background of the copy paper after 100,000 copies were made.

COMPARATIVE EXAMPLE 3

The procedure for preparation of the two-component-type developer No. 1 in Example 1 was repeated except that the carnauba wax containing 0.9 wt.% of free aliphatic acids used in Example 1 was replaced by a low-molecular-weight polypropylene (Trademark, "660P", made by Sanyo Chemical Industries, Ltd.), whereby comparative two-component-type developer No. 3 was obtained.

By using the above-obtained developer, images were continuously reproduced in the same manner as in Example 1. During the reproduction, the copy papers wound around the heat-application roller, and high quality images were not obtained.

The fixing properties of the developer were also evaluated in the same manner as in Example 1. The results are shown in Table 1. As shown in the table, the lower limit of the temperature range in which the developer gave rise to the hot off-set phenomenon was sufficiently high. However, the temperature at which the copy papers began to wind around the heat-application roller was high, and the lower limit of the temperature range in which toner images were fixed on the copy papers was high.

COMPARATIVE EXAMPLE 4

The procedure for preparation of the two-component-type developer No. 1 in Example 1 was repeated except that neither the carnauba wax nor the oxidized rice wax used in Example 1 was used, whereby comparative two-component-type developer No. 4 was obtained.

By using the above-obtained developer, images were continuously reproduced in the same manner as in Example 1. During the reproduction, the copy papers wound around the heat-application roller, and high quality images were not obtained.

The fixing properties of the developer were also evaluated in the same manner as in Example 1. The results are shown in Table 1. As shown in the table, the lower limit of the temperature range in which toner images were fixed on the copy papers was high.

EXAMPLE 2

The following components were thoroughly mixed in a Henschel mixer.

| | parts by weight |
|---|---|
| Polyester resin (Number-average molecular weight Mn = 5300, Weight-average molecular weight Mw = 51000, Glass transition temperature Tg = 59.5° C.) | 85 |
| Styrene - acrylic derivative copolymer | 15 |
| Carnauba wax containing 0.7 wt. % of free aliphatic acids (Melting point = 84° C., Acid value = 0.6) | 2.5 |
| Oxidized rice wax (Acid value = 15.0) | 2 |
| Carbon black (Trademark, "#44", made by Mitsubishi Carbon Co., Ltd.) | 10 |
| Chromium-containing monoazo dye (Trademark, "TRH", made by Hodogaya Chemical Co., Ltd.) | 2 |

The resulting mixture was placed in a roll mill pot, and kneaded at temperatures between 80° C. and 110° C. for approximately 40 minutes. The fused mixture was cooled to room temperature, crushed, and then classified, thereby obtaining a toner having a particle diameter of 5 to 20 μm.

3.5 parts by weight of the above-obtained toner and 96.5 parts by weight of oxidized iron powder carrier particles with a 150–250 mesh (Trademark, "TEFV", made by Nihon teppun Co., Ltd.) were mixed in a ball mill pot, whereby two-component-type developer No. 2 according to the present invention was obtained.

Images were continuously reproduced by using the above-obtained developer in the same manner as in Example 1.

The fixing properties of the developer were also evaluated in the same manner as in Example 1. The results are shown in Table 1. As shown in the table, the obtained data were all satisfactory.

EXAMPLE 3

The following components were thoroughly mixed in a Henschel mixer.

| | parts by weight |
|---|---|
| Polyester resin (Number-average molecular weight Mn = 5400, Weight-average molecular weight Mw = 56000, Glass transition temperature Tg = 60.0° C.) | 80 |
| Polystyrene | 20 |
| Carnauba wax containing 0.5 wt. % of free aliphatic acids (Melting point = 84° C., Acid value = 0.8) | 3 |
| Oxidized rice wax (Acid value = 16.0) | 1.5 |
| Carbon black (Trademark, "#44", made by Mitsubishi Carbon Co., Ltd.) | 8 |

The resulting mixture was placed in a roll mill pot, and kneaded at temperatures between 80° C. and 110° C. for approximately 40 minutes. The fused mixture was cooled to room temperature, crushed, and then classified, thereby obtaining a toner having a particle diameter of 5 to 20 μm.

Using the above obtained toner, two-component-type developer No. 3 according to the present invention was prepared in the same manner as in Example 1.

Images were continuously reproduced by using the above-obtained developer in the same manner as in Example 1.

The fixing properties of the developer were also evaluated in the same manner as in Example 1. The results are shown in Table 1. As shown in the table, the obtained data were all satisfactory.

EXAMPLE 4

The procedure for preparation of the two-component-type developer No. 1 in Example 1 was repeated except that the amount of the carnauba wax containing 0.9 wt.% of free aliphatic acids used in Example 1 was changed from 2 parts by weight to 1 part by weight, and that the amount of the oxidized rice wax used in Example 1 was changed from 1.5 parts by weight to 3 parts by weight, whereby two-component-type developer No. 4 was obtained.

By using the above-obtained developer, images were continuously reproduced in the same manner as in Example 1.

The fixing properties of the developer were also evaluated in the same manner as in Example 1. The results are shown in Table 1. As shown in the table, the obtained data were all satisfactory.

EXAMPLE 5

The following components were thoroughly mixed in a Henschel mixer.

| | parts by weight |
|---|---|
| Polyester resin (Number-average molecular weight Mn = 5000, Weight-average molecular weight Mw = 55000, Glass transition temperature Tg = 62.0° C.) | 100 |
| Montan ester wax (Acid value = 9.5) | 2 |
| Oxidized rice wax (Acid value = 13.0) | 1.5 |
| Carbon black (Trademark, "#44"), made by Mitsubishi Carbon Co., Ltd.) | 7 |
| Chromium-containing monoazo dye (Trademark, "TRH", made by Hodogaya Chemical Co., Ltd.) | 2 |

The resulting mixture was placed in a roll mill pot, and kneaded at temperatures between 80° C. and 110° C. for approximately 40 minutes. The fused mixture was cooled to room temperature, crushed, and then classified, thereby obtaining a toner having a particle diameter of 5 to 20 μm.

Using the above obtained toner, two-component-type developer No. 5 according to the present invention was prepared in the same manner as in Example 1.

Images were continuously reproduced by using the above-obtained developer in the same manner as in Example 1. During the continuous reproduction operation, neither the off-set phenomenon nor the winding phenomenon was observed. Even after 100,000 copies were made, high quality images were obtained and the quality underwent no deterioration.

The fixing properties of the developer were also evaluated in the same manner as in Example 1. The results are shown in Table 1. As shown in the table, the obtained data were all satisfactory.

COMPARATIVE EXAMPLE 5

The procedure for preparation of the two-component-type developer No. 5 in Example 5 was repeated except that the amount of the montan ester wax used in Example 5 was changed from 2 parts by weight to 3.5 parts by weight, and that the oxidized rice wax used in Example 5 was eliminated, whereby comparative two-component-type developer No. 5 was obtained.

By using the above-obtained developer, images were continuously reproduced in the same manner as in Example 5. During the reproduction, the image fixing performance at low temperatures was slightly insufficient. The initial image was excellent, but slight toner deposition was observed on the background of the copy paper after 100,000 copies were made.

The fixing properties of the developer were also evaluated in the same manner as in Example 1. The results are shown in Table 1.

COMPARATIVE EXAMPLE 6

The procedure for preparation of the two-component-type developer No. 5 in Example 5 was repeated except that the amount of the oxidized rice wax used in Example 5 was changed from 1.5 parts by weight to 3.5 parts by weight, and that the montan ester wax used in Example 5 was eliminated, whereby comparative two-component-type developer No. 6 was obtained.

By using the above-obtained developer, images were continuously reproduced in the same manner as in Example 5. During the reproduction, the image fixing performance at low temperatures was sufficient. The initial image was excellent, but slight toner deposition was observed on the background of the copy paper after 100,000 copies were made.

The fixing properties of the developer were also evaluated in the same manner as in Example 1. The results are shown in Table 1.

COMPARATIVE EXAMPLE 7

The procedure for preparation of the two-component-type developer No. 5 in Example 5 was repeated except that the montan ester wax used in Example 5 was replaced by a low-molecular-weight polypropylene (Trademark, "660P", made by Sanyo Chemical Industries, Ltd.), whereby comparative two-component-type developer No. 7 was obtained.

By using the above-obtained developer, images were continuously reproduced in the same manner as in Example 5. During the reproduction, the copy papers wound around the heat-application roller, and high quality images were not obtained.

The fixing properties of the developer were also evaluated in the same manner as in Example 1. The results are shown in Table 1. As shown in the table, the lower limit of the temperature range in which the developer gave rise to the hot off-set phenomenon was sufficiently high. However, the temperature at which the copy papers began to wind around the heat-application roller was high, and the lower limit of the temperature range in which toner images were fixed on the copy papers was high.

COMPARATIVE EXAMPLE 8

The procedure for preparation of the two-component-type developer No. 5 in Example 5 was repeated except that neither the montan ester wax nor the oxidized rice wax used in Example 5 was used, whereby comparative two-component-type developer No. 8 was obtained.

By using the above-obtained developer, images were continuously reproduced in the same manner as in Example 5. During the reproduction, the copy papers wound around the heat-application roller, and high quality images were not obtained.

The fixing properties of the developer were also evaluated in the same manner as in Example 1. The results are shown in Table 1.

EXAMPLE 6

The following components were thoroughly mixed in a Henschel mixer.

| | parts by weight |
|---|---|
| Polyester resin (Number-average molecular weight Mn = 5300, Weight-average molecular weight Mw = 51000, Glass transition temperature Tg = 59.5° C.) | 85 |
| Styrene - acrylic derivative copolymer | 15 |
| Montan ester wax (Acid value = 12.0) | 2 |
| Oxidized rice wax (Acid value = 15.0) | 2 |
| Carbon black (Trademark, "#44", made by Mitsubishi Carbon Co., Ltd.) | 10 |
| Chromium-containing monoazo dye (Trademark, "S-34", made by Orient Chemical Industries Ltd.) | 2 |

The resulting mixture was placed in a roll mill pot, and kneaded at temperatures between 80° C. and 110° C. for approximately 40 minutes. The fused mixture was cooled to room temperature, crushed, and then classified, thereby obtaining a toner having a particle diameter of 5 to 20 μm.

3.5 parts by weight of the above-obtained toner and 96.5 parts by weight of oxidized iron powder carrier particles with a 150–250 mesh (Trademark, "TEFV", made by Nihon teppun Co., Ltd.) were mixed in a ball mill pot, whereby two-component-type developer No. 6 according to the present invention was obtained.

Images were continuously reproduced by using the above-obtained developer in the same manner as in Example 5.

The fixing properties of the developer were also evaluated in the same manner as in Example 1. The results are shown in Table 1. As shown in the table, the obtained data were all satisfactory.

EXAMPLE 7

The following components were thoroughly mixed in a Henschel mixer.

| | parts by weight |
|---|---|
| Polyester resin (Number-average molecular weight Mn = 5300, Weight-average molecular weight Mw = 51000, Glass transition temperature Tg = 59.5° C.) | 80 |
| Polystyrene | 20 |
| Montan ester wax (Acid value = 6.5) | 1 |
| Oxidized rice wax (Acid value = 17.0) | 2.5 |
| Carbon black (Trademark, "#44", made by Mitsubishi Carbon Co., Ltd.) | 8 |
| Zinc salt of salicylic acid derivative | 3 |

The resulting mixture was placed in a roll mill pot, and kneaded at temperatures between 80° C. and 110° C. for approximately 40 minutes. The fused mixture was cooled to room temperature, crushed, and then classified, thereby obtaining a toner having a particle diameter of 5 to 20 μm.

Using the above obtained toner, two-component-type developer No. 7 according to the present invention was prepared in the same manner as in Example 5.

Images were continuously reproduced by using the above-obtained developer in the same manner as in Example 5. During the reproduction, neither the off-set phenomenon nor the winding phenomenon was observed. Even after 100,000 copies were made, high quality images were obtained and the quality underwent no deterioration.

The fixing properties of the developer were also evaluated in the same manner as in Example 1. The results are shown in Table 1. As shown in the table, the obtained data were all satisfactory.

EXAMPLE 8

The following components were thoroughly mixed in a Henschel mixer.

| | parts by weight |
|---|---|
| Polyester resin (Number-average molecular weight Mn = 5000, Weight-average molecular weight Mw = 55000, Glass transition temperature Tg = 62° C.) | 100 |
| Montan ester wax (Acid value = 13.0) | 3 |
| Oxidized rice wax (Acid value = 27.8) | 1 |
| Carbon black (Trademark, "#44", made by Mitsubishi Carbon Co., Ltd.) | 13 |
| Zinc salt of salicylic acid derivative | 3 |

The resulting mixture was placed in a roll mill pot, and kneaded at temperatures between 80° C. and 110°

C. for approximately 40 minutes. The fused mixture was cooled to room temperature, crushed, and then classified, thereby obtaining a toner having a particle diameter of 5 to 20 μm.

Using the above obtained toner, two-component-type developer No. 8 according to the present invention was prepared in the same manner as in Example 5.

Images were continuously reproduced by using the above-obtained developer in the same manner as in Example 5. During the reproduction, neither the off-set phenomenon nor the winding phenomenon was observed. Even after 100,000 copies were made, high quality images were obtained and the quality underwent no deterioration. The fixing properties of the developer were also evaluated in the same manner as in Example 1. The results are shown in Table 1. As shown in the table, the obtained data were all satisfactory.

EXAMPLE 9

The following components were thoroughly mixed in a Henschel mixer.

| | parts by weight |
|---|---|
| Polyester resin (Number-average molecular weight Mn = 5000, Weight-average molecular weight Mw = 55000, Glass transition temperature Tg = 62° C.) | 55 |
| Montan ester wax (Acid value = 13.0) | 4 |
| Oxidized rice wax (Acid value = 13.0) | 4 |
| Styrene - acrylic resin | 45 |
| Carbon black (Trademark, "#44", made by Mitsubishi Carbon Co., Ltd.) | 8 |
| Zinc salt of salicylic acid derivative | 3 |

The resulting mixture was placed in a roll mill pot, and kneaded at temperatures between 80° C. and 110° C. for approximately 40 minutes. The fused mixture was cooled to room temperature, crushed, and then classified, thereby obtaining a toner having a particle diameter of 5 to 20 μm.

Using the above obtained toner, two-component-type developer No. 9 according to the present invention was prepared in the same manner as in Example 5.

Images were continuously reproduced by using the above-obtained developer in the same manner as in Example 5. During the reproduction, neither the off-set phenomenon nor the winding phenomenon was observed. Even after 100,000 copies were made, high quality images were obtained and the quality underwent no deterioration.

The fixing properties of the developer were also evaluated in the same manner as in Example 1. The results are shown in Table 1. As shown in the table, the obtained data were all satisfactory.

TABLE 1

| Developer | (1) | (2) | (3) | (4) | Initial Image Quality (*) | Image Quality after 100000 copies (*) |
|---|---|---|---|---|---|---|
| No. 1 | 230 or more | 125 | 125 | 130 | ○ | ○ |
| No. 2 | 230 or more | 125 | 125 | 130 | ○ | ○ |
| Comp. No. 1 | 230 or more | 130 | 125 | 135 | ○ | Δ |

TABLE 1-continued

| Developer | (1) | (2) | (3) | (4) | Initial Image Quality (*) | Image Quality after 100000 copies (*) |
|---|---|---|---|---|---|---|
| Comp. No. 2 | 230 or more | 125 | 125 | 130 | ○ | Δ |
| Comp. No. 3 | 230 or more | 150 | 155 | 160 | Δ | x |
| Comp. No. 4 | 230 or more | 155 | 160 | 165 | Δ | x |
| No. 3 | 230 or more | 125 | 125 | 130 | ○ | ○ |
| No. 4 | 230 or more | 120 | 120 | 120 | ○ | ○ |
| No. 5 | 230 or more | 125 | 125 | 130 | ○ | ○ |
| No. 6 | 230 or more | 125 | 125 | 130 | ○ | ○ |
| No. 7 | 230 or more | 125 | 125 | 135 | ○ | ○ |
| No. 8 | 230 or more | 125 | 125 | 130 | ○ | ○ |
| No. 9 | 230 or more | 125 | 120 | 130 | ○ | ○ |
| Comp. No. 5 | 225 or more | 130 | 135 | 140 | ○ | Δ |
| Comp. No. 6 | 230 or more | 125 | 125 | 130 | ○ | Δ |
| Comp. No. 7 | 230 or more | 150 | 155 | 160 | Δ | x |
| Comp. No. 8 | 230 or more | 155 | 160 | 165 | Δ | x |

(*) The image quality was visually inspected in terms of the fogging on the background of the copy paper.
○: excellent image quality
: poor image quality
x: very poor image quality In the above table, the items (1), (2), (3) and (4) correspond to items (1) to (4) described in Example 1, and the unit thereof is "° C.".

EXAMPLE 10

The procedure for preparation of the two-component-type developer No. 1 in Example 1 was repeated except that the carnauba wax containing 0.9 wt.% of free aliphatic acids used in Example 1 was replaced by a carnauba wax containing 4.5 wt.% of free aliphatic acids (with a melting point of 83° C. and an acid value of 5.0), whereby two-component-type developer No. 10 according to the present invention was obtained.

By using the above-obtained developer, images were continuously reproduced in the same manner as in Example 1. During the reproduction, the obtained results were as satisfactory as the case where the developer No. 1 was used.

Then, an environmental variability degree of the developer was measured in accordance with the following formula:

$$\frac{\text{(Charge quantity at 10° C. and 15\% } RH) - \text{(Charge quantity at 30° C. and 90\% } RH)}{\left[\text{(Charge quantity at 10° C. and 15\% } RH) + \text{(Charge quantity at 30° C. and 90\% } RH)\right]/2} \times 100\ (\%)$$

When the obtained environmental variability degree of the developer is 40% or less, there is no problem for practical use. The ideal environmental variability degree is 0%.

The aforementioned environmental variability degree of the developer No. 10 was successfully decreased as compared with the case where the developer No. 1 was used.

EXAMPLE 11

The procedure for preparation of the two-component-type developer No. 2 in Example 2 was repeated except that the carnauba wax containing 0.7 wt.% of free aliphatic acids used in Example 2 was replaced by a carnauba wax containing 2.3 wt.% of free aliphatic acids (with a melting point of 83° C. and an acid value of 2.0), whereby two-component-type developer No. 11 according to the present invention was obtained.

By using the above-obtained developer, images were continuously reproduced in the same manner as in Example 1. During the reproduction, the obtained results were as satisfactory as the case where the developer No. 2 was used.

The environmental variability degree of the developer No. 11 was successfully decreased as compared with the case where the developer No. 2 was used.

EXAMPLE 12

The procedure for preparation of the two-component-type developer No. 1 in Example 1 was repeated except that the carnauba wax containing 0.9 wt.% of free aliphatic acids used in Example 1 was replaced by a carnauba wax containing 6 wt.% of free aliphatic acids (with a melting point of 83° C. and an acid value of 5.5), whereby two-component-type developer No. 12 according to the present invention was obtained.

By using the above-obtained developer, images were continuously reproduced in the same manner as in Example 1. During the reproduction, the obtained results were as satisfactory as the case where the developer No. 1 was used.

As compared with the case where the developer No. 1 was used, the temperature at which copy papers began to wind around the heat-application roller was slightly low, and the environmental variability degree was successfully decreased.

As described above, since the dry-type toners according to the present invention comprise a release agent comprising (a) a carnauba wax substantially free of free aliphatic acids and/or a montan ester wax and (b) an oxidized rice wax with an acid value of 10 to 30, the toners exhibit high resistance to the off-set and the winding phenomena, and the toner images can be firmly fixed on copy paper at low temperatures. Therefore, high-speed fixation can be successfully achieved by using the toners of the present invention. Moreover, the carnauba wax or montan ester wax and the oxidized rice wax can be well dispersed in a binder resin, so that the toners of the present invention do not cause the problem of filming, and carrier particles are not stained with the toner particles. High quality images can thus be stably obtained for a prolonged period of time.

What is claimed is:

1. A dry-type toner for electrophotography comprising a binder resin, a coloring agent, and a release agent, said release agent comprising (a) a carnauba wax substantially free of free aliphatic acids and/or a montan ester wax and (b) an oxidized rice wax with an acid value of 10 to 30.

2. The dry-type toner for electrophotography as claimed in claim 1, wherein said carnauba wax contains 5 wt.% or less of free aliphatic acids.

3. The dry-type toner for electrophotography as claimed in claim 1, wherein said carnauba wax contains 2 to 5 wt.% of free aliphatic acids.

4. The dry-type toner for electrophotography as claimed in claim 1, wherein said montan ester wax has an acid value of 5 to 14.

5. The dry-type toner for electrophotography as claimed in claim 1, wherein the amount of said carnauba wax and/or montan ester wax is 0.2 to 20 wt.% of the total weight of said dry-type toner.

6. The dry-type toner for electrophotography as claimed in claim 1, wherein the amount of said oxidized rice wax is 0.2 to 20 wt.% of the total weight of said dry-type toner.

7. The dry-type toner for electrophotography as claimed in claim 1, wherein said binder resin is a styrene-based resin containing both a high-molecular-weight component and a low-molecular weight component with the ratio (Mw/Mn) of the weight-average molecular weight (Mw) to the number-average molecular weight (Mn) being 3.5 or greater.

8. The dry-type toner for electrophotography as claimed in claim 1, wherein said binder resin is a polyester resin.

9. The dry-type toner for electrophotography as claimed in claim 1, further comprising a magnetic material.

10. The dry-type toner for electrophotography as claimed in claim 9, wherein the amount ratio of said magnetic material to said binder resin is 20 to 200 parts by weight to 100 parts by weight.

11. The dry-type toner for electrophotography as claimed in claim 9, wherein said magnetic material has an average diameter of 0.1 to 2 μm.

* * * * *